US011649996B2

(12) United States Patent
Ouyang et al.

(10) Patent No.: US 11,649,996 B2
(45) Date of Patent: May 16, 2023

(54) SYSTEM AND METHOD FOR OCR CONTROL IN PARALLELED COMPRESSORS

(71) Applicants: TRANE AIR CONDITIONING SYSTEMS (CHINA) CO., LTD., Taicang (CN); TRANE INTERNATIONAL INC., Davidson, NC (US)

(72) Inventors: Jun Ouyang, Taicang (CN); Long Zhang, Taicang (CN)

(73) Assignees: TRANE AIR CONDITIONING SYSTEMS (CHINA) CO., LTD., Taicang (CN); TRANE INTERNATIONAL INC., Davidson, NC (US)

( * ) Notice: Subject to any disclaimer, the term of this patent is extended or adjusted under 35 U.S.C. 154(b) by 32 days.

(21) Appl. No.: 17/492,860

(22) Filed: Oct. 4, 2021

(65) Prior Publication Data

US 2022/0026122 A1 Jan. 27, 2022

Related U.S. Application Data

(63) Continuation of application No. 16/929,833, filed on Jul. 15, 2020, now Pat. No. 11,137,180.

(30) Foreign Application Priority Data

Apr. 30, 2020 (CN) ..... 202010365546.2

(51) Int. Cl.
*F25B 31/02* (2006.01)
*F25B 41/31* (2021.01)
(Continued)

(52) U.S. Cl.
CPC ..... *F25B 31/02* (2013.01); *F25B 31/002* (2013.01); *F25B 39/00* (2013.01); *F25B 41/31* (2021.01);
(Continued)

(58) Field of Classification Search
CPC ..... F25B 31/02; F25B 41/31; F25B 41/40; F25B 31/002; F25B 39/00; F25B 2400/0751
See application file for complete search history.

(56) References Cited

U.S. PATENT DOCUMENTS 2,646,212 A 7/1953 Kellie
3,009,632 A 11/1961 Berger et al.
(Continued)

FOREIGN PATENT DOCUMENTS

CN 1325007 A 12/2001
FR 2956190 A1 8/2011
(Continued)

*Primary Examiner* — Nelson J Nieves
(74) *Attorney, Agent, or Firm* — Hamre, Schumann, Mueller & Larson, P.C.

(57) ABSTRACT

A heating, ventilation, air conditioning, and refrigeration (HVACR) system includes a first compressor having a first capacity, a second compressor having a second capacity, a condenser, an expansion device, and an evaporator fluidly connected. The first compressor and the second compressor are arranged in parallel. The first compressor includes a first lubricant sump. The second compressor includes a second lubricant sump. The first lubricant sump is fluidly connected to the second lubricant sump via a lubricant transfer conduit. A flow restrictor is disposed in the lubricant transfer conduit. The flow restrictor is configured to reduce a refrigerant flow between the first compressor and the second compressor.

15 Claims, 5 Drawing Sheets

(51) Int. Cl.
*F25B 41/40* (2021.01)
*F25B 31/00* (2006.01)
*F25B 39/00* (2006.01)

(52) U.S. Cl.
CPC ..... *F25B 41/40* (2021.01); *F25B 2400/0751* (2013.01)

(56) References Cited

U.S. PATENT DOCUMENTS

| | | | | |
|---|---|---|---|---|
| 3,072,318 | A | 1/1963 | Berger et al. | |
| 3,140,041 | A | 7/1964 | Israel et al. | |
| 3,621,670 | A | 11/1971 | Kinney | |
| 3,719,057 | A | 3/1973 | Grant | |
| 3,775,995 | A | 12/1973 | Conley et al. | |
| 4,102,149 | A | 7/1978 | Conley et al. | |
| 4,365,983 | A | 12/1982 | Abraham et al. | |
| 4,383,802 | A | 5/1983 | Gianni et al. | |
| 4,411,141 | A | 10/1983 | Hara | |
| 4,418,548 | A | 12/1983 | Sawyer | |
| 4,822,259 | A | 4/1989 | Basseggio | |
| 5,094,598 | A | 3/1992 | Amata et al. | |
| 5,150,586 | A | 9/1992 | Basseggio | |
| 5,236,311 | A | 8/1993 | Lindstrom | |
| 6,948,916 | B2 | 9/2005 | Hebert | |
| 7,651,322 | B2 | 1/2010 | Shaw | |
| 9,273,678 | B2 | 3/2016 | Bonnefoi et al. | |
| 2003/0230098 | A1 | 12/2003 | Moon et al. | |
| 2007/0033954 | A1 | 2/2007 | Jang et al. | |
| 2009/0277213 | A1 | 11/2009 | Sakitani et al. | |
| 2011/0132026 | A1 | 6/2011 | Takeichi | |
| 2013/0298594 | A1 | 11/2013 | Bonnefoi et al. | |
| 2014/0241909 | A1 | 8/2014 | Perevozchikov et al. | |
| 2015/0167660 | A1 | 6/2015 | Crolius et al. | |
| 2016/0018143 | A1* | 1/2016 | Inaba | F25B 39/00 62/527 |
| 2017/0016438 | A1 | 1/2017 | Fan et al. | |
| 2017/0211855 | A1 | 7/2017 | Fraser et al. | |
| 2017/0284706 | A1 | 10/2017 | Ozu et al. | |
| 2018/0340526 | A1 | 11/2018 | Goel et al. | |
| 2019/0203716 | A1* | 7/2019 | Borkowski | F04C 29/02 |
| 2020/0072521 | A1 | 3/2020 | Goel et al. | |

FOREIGN PATENT DOCUMENTS

| | | | |
|---|---|---|---|
| JP | 2008151405 | A | 7/2008 |
| KR | 20110087778 | A | 8/2011 |
| WO | 2010122812 | A1 | 10/2010 |

* cited by examiner

SYSTEM AND METHOD FOR OCR CONTROL IN PARALLELED COMPRESSORS

FIELD

This disclosure relates generally to heating, ventilation, air conditioning, and refrigeration (HVACR) systems. More specifically, the disclosure relates to systems and methods for controlling lubricant circulation rate in an HVACR system with compressors arranged in parallel.

BACKGROUND

A heat transfer circuit for an HVACR system generally includes a compressor, a condenser, an expansion device, and an evaporator fluidly connected. The compressor typically includes rotating component(s) that are driven by motor(s). The HVACR system can include a rooftop unit to provide conditioned air to an air distribution system that includes ductwork. The heat transfer circuit can include a plurality of compressors. In an application, one or more of the plurality of compressors can be turned on or off during operation.

SUMMARY

This disclosure relates generally to HVACR systems. More specifically, the disclosure relates to systems and methods for controlling lubricant circulation rate in an HVACR system with compressors arranged in parallel.

Embodiments disclosed herein are directed to lubricant (e.g., oil) circulation rate control with a plurality of compressors connected in parallel. The plurality of compressors includes a compressor including a lubricant sump. The compressor is driven by a motor. The motor includes a stator and a rotor. In some embodiments, the compressor is a hermetic compressor with the motor and a compression part disposed inside an enclosure of the compressor. In some embodiments, the lubricant sump is disposed at a relatively vertically lower portion of the compressor such that lubricant can be collected in the lubricant sump via gravitational force. In some embodiments, the lubricant is entrained in a heat transfer fluid of a heat transfer circuit of the HVACR system.

In some embodiments, the plurality of compressors can include first and second compressors. In some embodiments, the first compressor can be a variable speed compressor and the second compressor can be a fixed speed compressor. In some embodiments, both the first compressor and the second compressor can be fixed speed compressors or variable speed compressors. In some embodiments, the first compressor and/or the second compressor can be scroll compressor(s).

In some embodiments, the plurality of compressors can include more than two compressors. In some embodiments, the plurality of compressors can include three compressors. In some embodiments, the plurality of compressors can include four compressors. In some embodiments, the plurality of compressors includes at least one variable speed compressor.

In some embodiments, a flow restrictor can be disposed in a lubricant transfer conduit between lubricant sumps of the paralleled compressors to reduce the (heat transfer fluid) gas flow through the lubricant transfer conduit. In one embodiment, the flow restrictor can be disposed in/around the middle of a length of the lubricant transfer conduit. It will be appreciated that the location of the flow restrictor can be anywhere in the lubricant transfer conduit, as long as a desired range of lubricant circulation rate can be maintained. In some embodiments, the desired range of lubricant circulation rate is predetermined. In some embodiments, there can be a flow restrictor in each/every lubricant transfer conduit (that connects a pair of compressors).

In some embodiments, a suction conduit design can be deployed to allow lubricant to return to the compressor that has a lower capacity more easily (e.g., to obtain the lubricant more easily in the returned/suction heat transfer fluid), compared with the compressor having a higher capacity in a set of paralleled compressors.

An HVACR system is disclosed. The system includes a first compressor having a first capacity, a second compressor having a second capacity, a condenser, an expansion device, and an evaporator fluidly connected. The first compressor and the second compressor are arranged in parallel. The first compressor includes a first lubricant sump. The second compressor includes a second lubricant sump. The first lubricant sump is fluidly connected to the second lubricant sump via a lubricant transfer conduit. A flow restrictor is disposed in the lubricant transfer conduit. The flow restrictor is configured to reduce a refrigerant flow between the first compressor and the second compressor.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

Figure 1A:
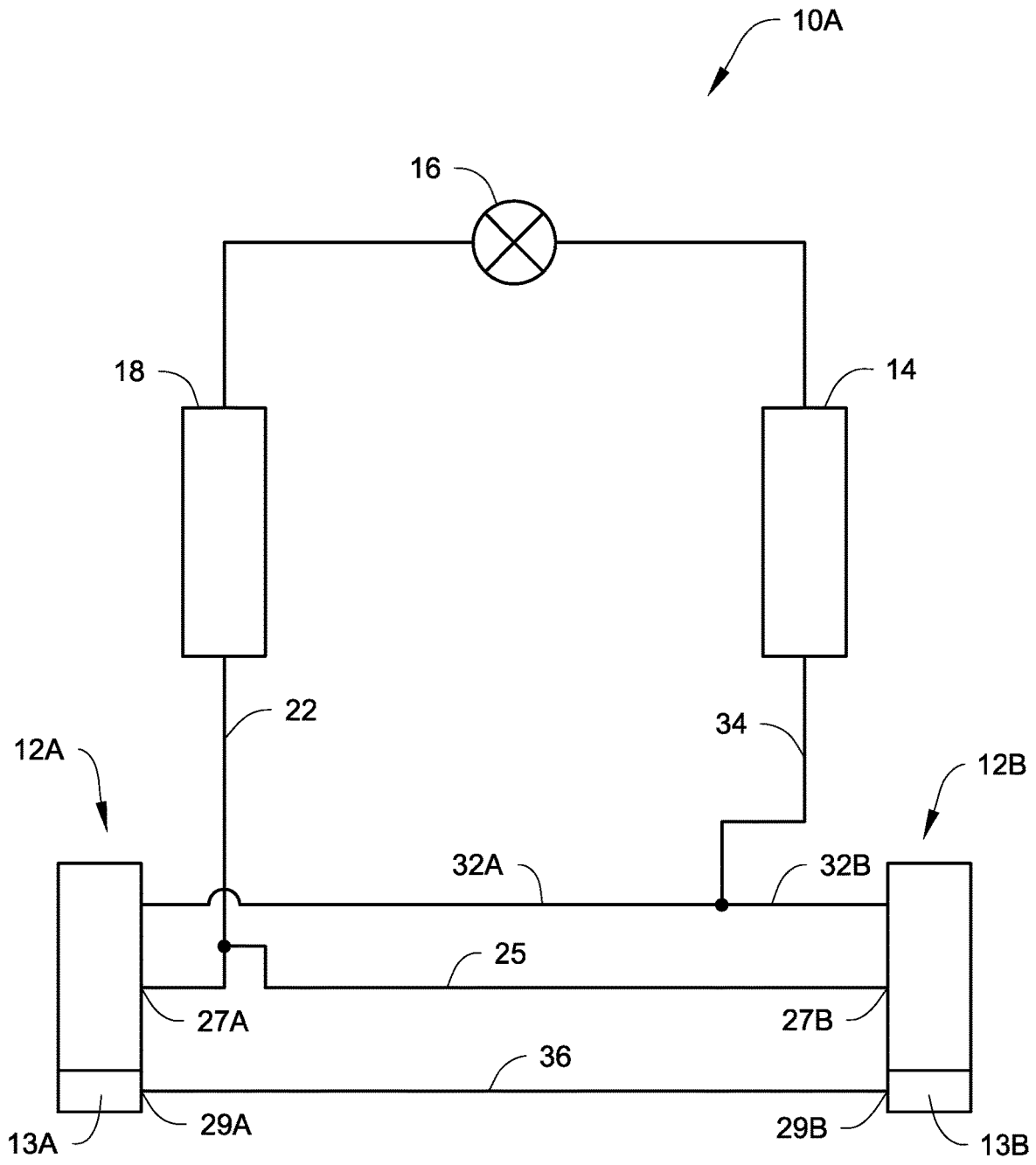
FIG. 1A is a schematic diagram of a heat transfer circuit, according to an embodiment.

This disclosure relates generally to HVACR systems. More specifically, the disclosure relates to systems and methods for controlling lubricant circulation rate in an HVACR system with compressors arranged in parallel.

In some embodiments, a heat transfer circuit can include a plurality of compressors. The plurality of compressors can be connected in parallel in the heat transfer circuit. Suction conduit(s) can be fluidly connected to suction inlets of the plurality of compressors. A heat transfer fluid and lubricant mixture can flow through the suction conduit(s) and enter the suction inlets of the plurality of compressors. Each of the plurality of compressors can include a lubricant sump. Each compressor can be driven by a motor that is disposed in the same case/shell/container as the compressor. In some embodiments, the lubricant sump can be disposed at a relatively vertically lower portion of the compressor such that lubricant can be collected in the lubricant sump via gravitational force. In some embodiments, the lubricant can be entrained in a heat transfer fluid of a heat transfer circuit of the HVACR system. It will be appreciated that a heat transfer fluid (e.g., refrigerant) can include a portion of a heat transfer fluid (e.g., refrigerant) and lubricant (e.g., oil) mixture.

The lubricant can be accordingly provided to one or more the plurality of compressors via the corresponding suction inlet through the suction conduit(s) which provide(s) gaseous heat transfer fluid from an evaporator of the heat transfer circuit to the plurality of compressors. The lubricant can flow through the gaps between the enclosure of the compressor and the stator of the motor and/or between the stator and the rotor of the motor to return to the compressor sump. The gaps can allow the lubricant to flow from the suction cavity of the compressor to return to the compressor sump. In some embodiments, when one (or more) of the compressors is turned off, the heat transfer circuit cannot reliably return lubricant to the sump of the compressor(s) that is turned on. This is because the gaseous heat transfer fluid can flow through the compressor(s) that is turned off, and through a lubricant transfer conduit (e.g., a lubricant equalizer line), and flows up through the gaps of the compressor(s) that is turned on. This can cause lubricant to stay in a suction cavity of the compressor rather than draining (down to the sump) through the gaps. As such, there can be low lubricant levels in the compressors. In some embodiment, the gaps can be increased to allow lubricant to drain (down to the sump) through the gaps. In some embodiments, increasing the size of the gaps might not be feasible due to the compressor's internal geometry limits (e.g., limited size).

The embodiments disclosed herein can help to keep lubricant in (the lubricant sump of) the compressor(s) as much as possible, and to improve the reliability of the compressor(s). For example, a flow restrictor (described later) can help to reduce lubricant/oil circulation rate (OCR) of the paralleled compressors system, and thus improving the heat exchange efficiency of the system e.g., under a partial load condition, improving energy efficiency, and saving energy.

FIG. 1A is a schematic diagram of a heat transfer circuit 10A, according to an embodiment. The heat transfer circuit 10A generally includes a plurality of compressors 12A, 12B, a condenser 14, an expansion device 16, and an evaporator 18. The expansion device 16 allows the working fluid to expand. The expansion causes the working fluid to significantly decrease in temperature. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any suitable type of expander used in the field for expanding a working fluid to cause the working fluid to decrease in pressure and temperature. The heat transfer circuit 10A is exemplary and can be modified to include additional components. For example, in some embodiments the heat transfer circuit 10A can include other components such as, but not limited to, an economizer heat exchanger, one or more flow restrictors, a receiver tank, a dryer, a suction-liquid heat exchanger, or the like.

The heat transfer circuit 10A can generally be applied in a variety of systems used to control an environmental condition (e.g., temperature, humidity, air quality, or the like) in a space (generally referred to as a conditioned space). Examples of systems include, but are not limited to, HVACR systems, transport refrigeration systems, or the like.

The components of the heat transfer circuit 10A are fluidly connected. The heat transfer circuit 10A can be specifically configured to be a cooling system (e.g., an air conditioning system) capable of operating in a cooling mode. Alternatively, the heat transfer circuit 10A can be specifically configured to be a heat pump system which can operate in both a cooling mode and a heating/defrost mode.

The heat transfer circuit 10A can operate according to generally known principles. The heat transfer circuit 10A can be configured to heat or cool a heat transfer fluid or medium (e.g., a liquid such as, but not limited to, water or the like), in which case the heat transfer circuit 10A may be generally representative of a liquid chiller system. The heat transfer circuit 10A can alternatively be configured to heat or cool a heat transfer fluid or medium (e.g., a gas such as, but not limited to, air or the like), in which case the heat transfer circuit 10A may be generally representative of an air conditioner or heat pump.

In operation, the compressors 12A, 12B compress a heat transfer fluid (e.g., refrigerant or the like) from a relatively lower pressure gas to a relatively higher-pressure gas. The relatively higher-pressure and higher temperature gas is discharged from the compressors 12A, 12B and flows through the condenser 14. In accordance with generally known principles, the heat transfer fluid flows through the condenser 14 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer fluid or medium (e.g., water, air, etc.), heating the heat transfer fluid, and converting it to a gaseous form. The gaseous heat transfer fluid then returns to the compressors 12A, 12B. The above-described process continues while the heat transfer circuit 10A is operating, for example, in a cooling mode (e.g., while the compressors 12A, 12B are enabled).

The compressors 12A, 12B can be, for example, but are not limited to, scroll compressors. In some embodiments, the compressors 12A, 12B can be other types of compressors. Examples of other types of compressors include, but are not limited to, reciprocating compressors, positive displacement compressors, or other types of compressors suitable for use in the heat transfer circuit 10A and having a lubricant sump. The compressor 12A can be generally representative of a variable speed compressor and the compressor 12B can be generally representative of a fixed speed compressor. In some embodiments, both the compressor 12A and the compressor 12B can be fixed speed compressors or variable speed compressors. In some embodiments, the compressors 12A, 12B can alternatively be step control compressors (e.g., compressors having two or more steps within a compressor). In some embodiments, the compressors 12A, 12B can be compressors having different capacities. For example, compressor 12A can have a relatively greater capacity than compressor 12B, according to some embodiments. It will be appreciated that alternatively the compressor 12B can have a relatively greater capacity than compressor 12A. In some embodiments, the capacity of the compressor 12A and/or 12B can be within the range from at or about 10 tons to at or about 25 tons.

The compressors 12A, 12B are connected in parallel in the heat transfer circuit 10A. In a paralleled compressors system configuration, the suction conduits (e.g., lines, pipes) of a plurality of compressors are connected to each other, and these suction conduits are connected to a common suction conduit (main suction conduit). The common suction conduit connects to the evaporator to receive gaseous heat transfer fluid from the evaporator. The discharge conduits of the plurality of compressors are connected to each other, and these discharge conduits are connected to a common discharge conduit (main discharge conduit). The common discharge conduit connects to the condenser so that the higher-pressure and higher temperature gas discharged from the compressors can flow through the condenser. The lubricant sumps of the compressors are fluidly connected via a lubricant transfer conduit. The lubricant transfer conduit can be referred to as an oil equalizer. Under such configuration, the plurality of compressors are connected in parallel. One advantage of such configuration is that, each of the plurality of compressors can be turned on or off (and thus the overall capacity of the compressors can be changed) according to the load requirements/changes of the heat transfer circuit, so that the overall capacity of the compressors (or the overall cooling and/or heating capacity of the heat transfer circuit) can be adjusted to be suitable for the load changes. In some embodiment, the paralleled compressors system can be referred to as a manifold.

Accordingly, the gaseous heat transfer fluid exiting the evaporator 18 is provided via a main suction conduit 22 (e.g., a suction line/pipe) and a branch suction conduit 25 to each of the compressors 12A, 12B, respectively. In one embodiment, the main suction conduit 22 is directly connected to one of the compressors 12A, 12B, and the branch suction conduit is directly connected to the other of the compressors 12A, 12B. The branch suction conduit 25 is branched off from the main suction conduit 22. A connector (e.g., a T-shape connector) can connect the branch suction conduit 25 to the main suction conduit 22. In the illustrated embodiment of FIG. 1A, the main suction conduit 22 is fluidly connected to a suction inlet 27A of the compressor 12A, and the branch suction conduit 25 is fluidly connected to a suction inlet 27B of the compressor 12B. The main suction conduit 22 and the branch suction conduit 25 share a common conduit, which extends from the outlet of the evaporator 18 to the connector. The main suction conduit 22 (including the common conduit portion) further extends from the connector to the suction inlet 27A. The branch suction conduit 25 (including the common conduit portion) branches off from the main suction conduit 22 at the connector and is fluidly connected to the suction inlet 27B. In such embodiment, the pressure drop in the branched suction conduit 25 is greater than the pressure drop in the main suction conduit 22.

Following compression, the relatively higher-pressure and higher-temperature gas is discharged from compressor 12A via discharge conduit 32A and from compressor 12B via discharge conduit 32B. In some embodiments, the discharge conduits 32A, 32B of the compressors 12A, 12B are joined at discharge conduit 34 to provide the combined relatively higher-pressure and higher temperature gas to the condenser 14.

The heat transfer fluid in the heat transfer circuit 10A generally includes a lubricant entrained with the heat transfer fluid. The lubricant is provided to the compressors 12A, 12B for example to lubricate bearings and seal leak paths of the compressors 12A, 12B. When the relatively higher-pressure and higher-temperature heat transfer fluid is discharged from the compressors 12A, 12B, the heat transfer fluid generally carries along with it a portion of the lubricant, which is initially delivered to the compressors 12A, 12B with the heat transfer fluid that enters the compressors 12A, 12B via the main suction conduit 22. A portion of the lubricant is maintained in the lubricant sumps 13A, 13B of the compressors 12A, 12B.

The lubricant sumps 13A, 13B of the compressors 12A, 12B are fluidly connected via a lubricant transfer conduit 36. The lubricant transfer conduit 36 is disposed at a lubricant level of the lubricant sumps 13A, 13B which permits lubricant to flow between the compressor 12A and the compressor 12B. Fluid flow of the lubricant is controlled by a pressure differential between the lubricant sump 13A of the compressor 12A and the lubricant sump 13B of the compressor 12B.

In some embodiments, the lubricant transfer conduit 36 can be a lubricant equalizer line configured to equalize a pressure in the lubricant sump 13A and a pressure in the lubricant sump 13B. The lubricant transfer conduit 36 is fluidly connected to the lubricant sump 13A via a sump inlet 29A of the compressor 12A and with the lubricant sump 13B via a sump inlet 29B of the compressor 12B. It will be appreciated that in some embodiments, 29A and/or 29B can be inlets for receiving lubricant from the compressor having higher pressure in the lubricant sump, and can also be outlets for transferring lubricant to the compressor having lower pressure in the lubricant sump.

Figure 1B:
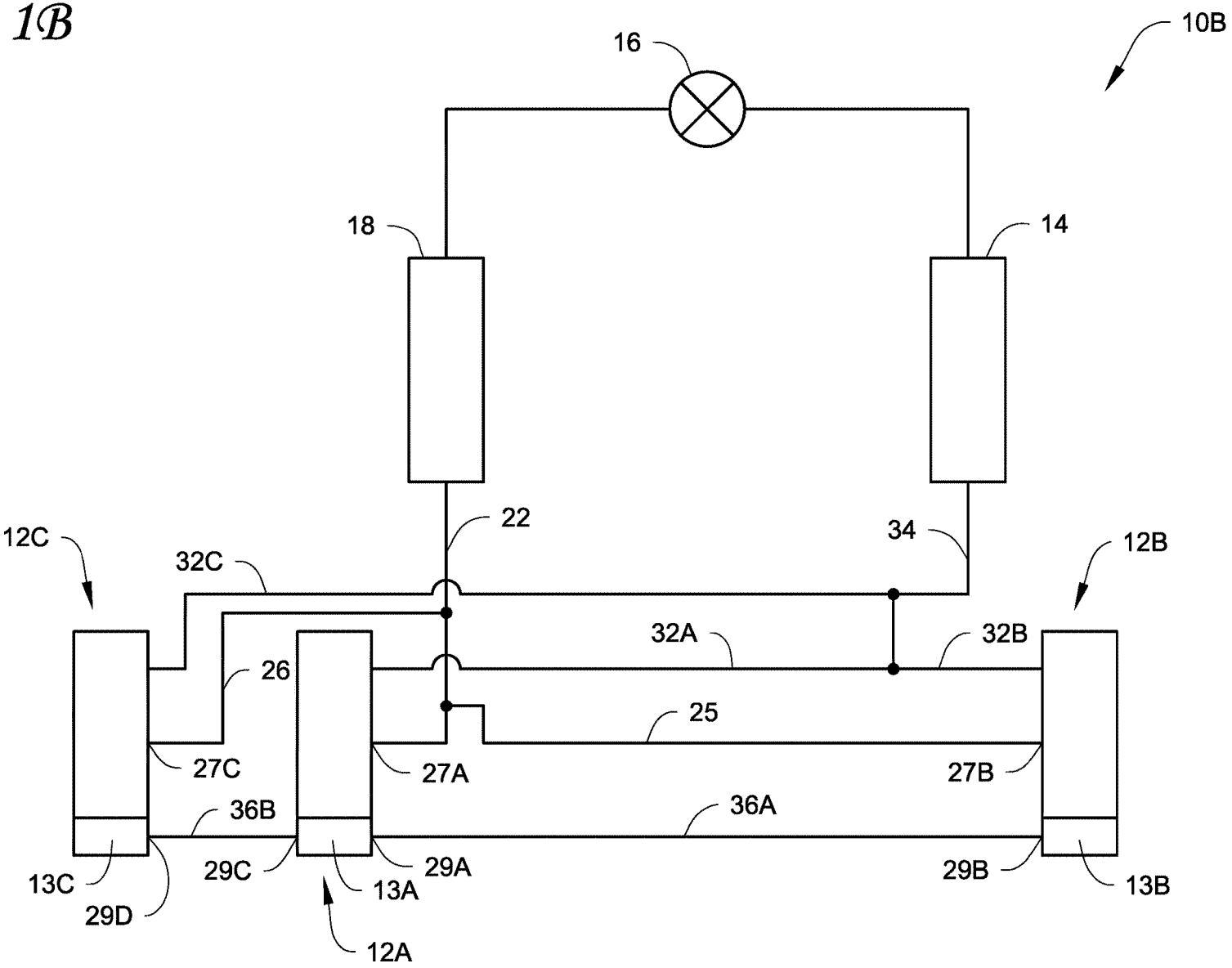
FIG. 1B is a schematic diagram of a heat transfer circuit, according to another embodiment.

FIG. 1B is a schematic diagram of a heat transfer circuit 10B, according to another embodiment. The heat transfer circuit 10B is similar to the heat transfer circuit 10A shown in FIG. 1A. Differences between the heat transfer circuit 10B from the heat transfer circuit 10A are described below.

The heat transfer circuit 10B includes a third compressor 12C. The compressors 12A, 12B, and 12C are connected in parallel in the heat transfer circuit 10B. Accordingly, the gaseous heat transfer fluid exiting the evaporator 18 is provided via the main suction conduit 22, the branch suction conduit 25, and another branch suction conduit 26 to each of the compressors 12A, 12B, and 12C, respectively.

Following compression, the relatively higher-pressure and higher-temperature gas is discharged from compressor 12A via discharge conduit 32A, from compressor 12B via discharge conduit 32B, and from compressor 12C via discharge conduit 32C. In some embodiments, the discharge conduits 32A, 32B, 32C of the compressors 12A, 12B, 12C are joined at discharge conduit 34 to provide the combined relatively higher-pressure and higher temperature gas to the condenser 14. For example, the discharge conduits 32A and 32B can be joined (e.g., using a T-shape connector), and then the joined discharge conduit (of 32A and 32B) can be joined with discharge conduit 32C (e.g., using a T-shape connector). In another embodiment, the discharge conduits 32A and 32C can be joined, and then the joined conduit and 32B can be joined. In yet another embodiment, the discharge conduits 32C and 32B can be joined, and then the joined conduit and 32A can be joined.

The branch suction conduit 25 is fluidly connected to main suction conduit 22. A connector (e.g., a T-shape connector) can connect the branch suction conduit 25 to the main suction conduit 22. The branch suction conduit 26 is fluidly connected to main suction conduit 22. A connector (e.g., a T-shape connector) can connect the branch suction conduit 26 to the main suction conduit 22. The main suction conduit 22, the branch suction conduit 25, and the branch suction conduit 26 are fluidly connected to a suction inlet 27A of the compressor 12A, a suction inlet 27B of the compressor 12B, and a suction inlet 27C of the compressor 12C, respectively.

The lubricant sumps 13A, 13B of the compressors 12A, 12B are fluidly connected via the lubricant transfer conduit 36A. The lubricant sumps 13A, 13C of the compressors 12A, 12C are fluidly connected via the lubricant transfer conduit 36B. The lubricant transfer conduit 36A is disposed at a lubricant level of the lubricant sumps 13A, 13B which permits lubricant to flow between the compressor 12A and the compressor 12B. The lubricant transfer conduit 36B is disposed at a lubricant level of the lubricant sumps 13A, 13C which permits lubricant to flow between the compressor 12A and the compressor 12C.

The lubricant transfer conduit 36A is fluidly connected to a sump inlet 29A of the lubricant sump 13A of the compressor 12A and a sump inlet 29B of the lubricant sump 13B of the compressor 12B. The lubricant transfer conduit 36B is fluidly connected to a sump inlet 29C of the lubricant sump 13A of the compressor 12A and a sump inlet 29D of the lubricant sump 13C of the compressor 12C. In some embodiments, the sump inlet 29A and the sump inlet 29C can be the same inlet/outlet. It will be appreciated that in some embodiments, 29A and/or 29B and/or 29C and/or 29D can be inlets for receiving lubricant (e.g., receiving lubricant from the compressor having higher pressure in the lubricant sump). In some embodiments, 29A and/or 29B and/or 29C and/or 29D can be outlets for transferring lubricant (to the compressor having lower pressure in the lubricant sump).

It will be appreciated that this process can be repeated for additional compressors (fourth, fifth, etc. that also connected in parallel in the heat transfer circuit), as long as only two compressors are connected per lubricant transfer conduit (e.g., 36A, 36B, etc.). In some embodiments, the lubricant transfer conduit (36A, 36B) can be a lubricant equalizer line configured to equalize a pressure in the lubricant sump 13A and a pressure in the lubricant sump 13B (and/or a pressure in the lubricant sump 13A and a pressure in the lubricant sump 13C).

Figure 2A:
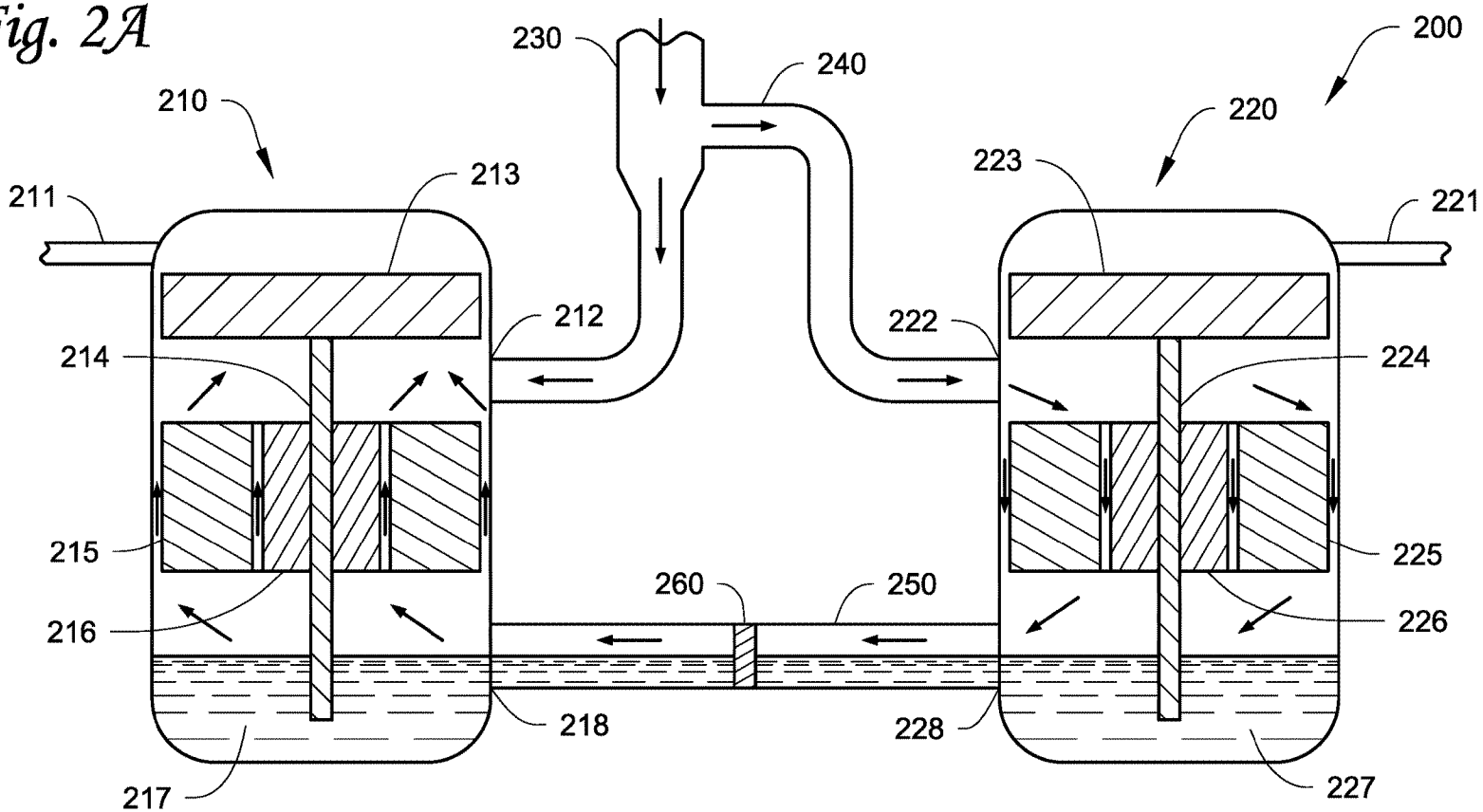
FIG. 2A is a schematic diagram of two compressors arranged in parallel with a flow restrictor, according to an embodiment.
Figure 2B:
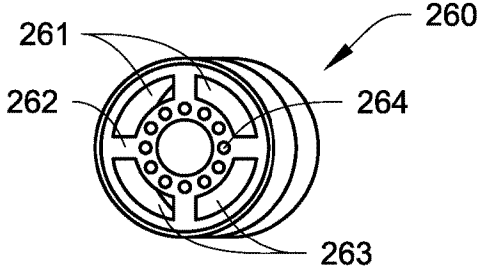
FIG. 2B illustrates the flow restrictor of FIG. 2A.

FIG. 2A is a schematic diagram 200 of two compressors 210, 220 arranged in parallel with a flow restrictor 260, according to an embodiment. FIG. 2B illustrates the flow restrictor 260 of FIG. 2A. It will be appreciated that each of the compressors 210, 220 can be any one of the compressors 12A, 12B, or 12C as shown in FIGS. 1A and 1B. It will also be appreciated that the compressors 210, 220 have similar structures, and thus the components of one compressor described herein are applicable to another compressor unless otherwise specified. In one embodiment, the compressors 210, 220 can be scroll compressors. A scroll compressor can be a compressor having two scrolls (e.g., interleaving scrolls) to pump, compress, or pressurize fluids such as liquids and gases. Typically one of the scrolls of the scroll compressor is fixed, while the other orbits eccentrically without rotating, thereby trapping and pumping or compressing pockets of fluid between the scrolls.

The compressor 210 includes a suction port 212, a discharge port 211, a compression part 213, a shaft 214, a motor having a stator 215 and a rotor 216, a lubricant sump 217, and a lubricant port 218. The compressor 220 includes a suction port 222, a discharge port 221, a compression part 223, a shaft 224, a motor having a stator 225 and a rotor 226, a lubricant sump 227, and a lubricant port 228. In one embodiment, the compressor 210 and/or the compressor 220 can be hermetic compressor(s).

The compressor 210 can be a scroll compressor. The compression part 223 can include a non-orbiting scroll member (or a stationary scroll member, or a fixed scroll member), an orbiting scroll member intermeshed with the non-orbiting scroll member (e.g., by means of an Oldham coupling), forming a compression chamber within the housing of the compressor 210.

In the compressor 210, the suction port 212 is disposed between the compression part 213 and the motor (215, 216). The discharge port 211 is disposed at a top portion of the compressor 210 above the compression part 213. The motor (215, 216) is configured to drive the compression part 213 via the shaft 214 to compress a heat transfer fluid (e.g., refrigerant or the like) from a relatively lower pressure gas to a relatively higher-pressure gas. The relatively higher-pressure gas can be discharged out of the compressor 210 from the discharge port 211. The lubricant sump 217 is disposed at the bottom of the compressor 210.

It will be appreciated that in some embodiments, in the lubricant sump 217, a predetermined amount (level, height, etc.) of lubricant (e.g., oil) is required so that the oil pump (not shown, typically disposed at the bottom of the shaft 214) can pump the lubricant upwards to lubricate motion parts such as bearings, compression parts, etc. where lubrication is needed.

Lubricant is entrained in the heat transfer fluid (e.g., refrigerant or the like). During the operation of the compressor 210, lubricant can return to the lubricant sump 217 in two paths so that the lubricant level in the lubricant sump 217 can be at a desirable level (amount, height, etc.), which may be predetermined. One path is that the lubricant (entrained in the gaseous heat transfer fluid) can be returned from the outside of the compressor 210 (e.g., from the evaporator) via the suction conduit 230 back into the lubricant sump 217 of the compressor 210. Another path is that lubricant pumped by the lubricant pump from the lubricant sump 217 to the upper lubrication surface (of the motion parts such as bearings, compression parts, etc.) of the compressor 210 can be returned back into the lubricant sump 217. After the lubrication is completed, the lubricant flows down to the lubricant sump 217.

In both paths, lubricant passes through the (vertical) gaps in the middle of the compressor. The gaps include gap(s) between the enclosure of the compressor 210 and the stator 215, and/or gap(s) between the stator 215 and the rotor 216. It will be appreciated that the gap(s) is/are relatively small in size (limited due to e.g., the size and/design limitation of the compressor), and gas flow from the bottom of the compressor 210 can prevent the lubricant from flowing back to the lubricant sump 217. In some embodiments, the gap(s) can be increased to allow lubricant to drain down to the lubricant sump 217.

When the compressor 210 and the compressor 220 are arranged in parallel in the heat transfer circuit, a lubricant loss phenomenon (e.g., oil loss phenomenon) may occur. One typical lubricant loss phenomenon is when the two compressors 210 and 220 are unbalanced (e.g., one compressor is on and the other compressor is off, or one compressor has a greater capacity than the other compressor), there can be gas flow (e.g., gaseous heat transfer fluid from the lubricant sump of one compressor to the lubricant sump of the other compressor) in the lubricant transfer conduit (e.g., oil equalizer) 250 between the two compressors 210, 220. Such gas flow can flow into one of the compressors with a greater capacity (and/or the one compressor that is turned on), and then flows upward in that compressor through the gaps (between the enclosure and the stator and/or between the stator and the rotor of the one compressor), and then flows into the suction cavity of the compressor and is then discharged outside of the compressor through its discharge port. When such upward gas flow is large/strong enough, the upward gas flow can affect the lubricant circulation inside the compressor and prevent lubricant from flowing back to the lubricant sump. As a result, a large lubricant circulation rate (oil circulation rate, "OCR") can occur. A relatively large OCR can result in lubricant loss in the compressor, and thus affect the lubrication function of the compressor. For example, when the heat transfer fluid is sampled in the suction cavity of the compressor, the percentage/amount of the lubricant in the heat transfer fluid can be relatively high (more concentrated due to a larger upward gas flow), and as a result, the OCR can be high.

As illustrated in FIG. 2A, when compressor 210 is turned on and the compressor 220 is turned off (or when the compressor 210 has a greater capacity than the compressor 220), gas flow (indicated by the arrow) enters the compressor includes both the gas flow from the suction conduit 230 and the gas flow (referred to as the "upward gas flow") from the compressor 220 via the lubricant transfer conduit 250. When the upward gas flow is large/strong enough, the upward gas flow can prevent lubricant from retuning back to the lubricant sump 217. The upward gas flow and the gas flow from the suction conduit 230 can enter the suction cavity and then be discharged outside of the compressor 210 through its discharge port 211. As a result, a high OCR can occur which can result in a lower lubricant level (than a desirable level) in the lubricant sump 217 of the compressor 210, and the reliability of the compressor 210 can be affected.

Suction conduit design can help reduce the OCR. As illustrated in FIG. 2A, the suction conduit 230 is a main suction conduit (that is directly connected to the evaporator, see FIGS. 1A and 1B). Suction conduit 240 is a branch suction conduit that is branched off from the main suction conduit 230. Typically, the pressure drop (of the gaseous heat transfer fluid) in a branch suction conduit can be higher than the pressure drop in the main suction conduit. The pressure drop differences can be determined by, for example, the gravity of the lubricant, and/or shape and/or radius of the suction conduit(s) and/or whether there is a branch, etc.

It will be appreciated that by connecting compressor 220 (that has a lower capacity than compressor 210, or is turned off while compressor 210 is turned on) to a branch suction conduit and connecting the compressor 210 to a main suction conduit, a higher pressure drop can occur in the compressor 220 than the pressure drop in the compressor 210. As a result, there can be less/reduced gas flow from the compressor 220 to the compressor 210 via the lubricant transfer conduit 250, which results in less/reduced upward gas flow in compressor 210, and less/reduced OCR (higher/increased reliability of compressor 210) can be achieved.

It will be appreciated that differences in suction conduit design (e.g., which compressor is connected to the main suction conduit, different resistance to the heat transfer fluid in the different suction conduits, etc.), in compressor capacity, and/or in the size/shape of the gaps (between the enclosure and the stator and/or between the stator and the rotor) in the compressor can change the upward gas flow (amount, rate, etc.), which can in turn change the lubricant loss phenomenon and/or the OCR.

For example, the suction conduit design as illustrated in FIG. 2A (i.e., the compressor 210 being connected to the main suction conduit 230 and the compressor 220 being connected to the branch suction conduit 240) would cause a larger (suction heat transfer fluid) pressure drop in the compressor 220 than the pressure drop in the compressor 210. As such, the gas flow (amount, rate, etc.) through the lubricant transfer conduit 250 is larger when the compressor 220 is turned on and the compressor 210 is turned off, compared with the gas flow (amount, rate, etc.) through the lubricant transfer conduit 250 when the compressor 210 is turned on and the compressor 220 is turned off. A larger gas flow (amount, rate, etc.) through the lubricant transfer conduit 250 can cause a larger upward gas flow and in turn a larger OCR (less/reduced lubricant in the compressor, larger lubricant loss, less reliability). That is, the suction conduit design as illustrated in FIG. 2A can result in alleviated/less/reduced OCR when the compressor 210 is turned on and the compressor 220 is turned off, but might have undesirable effect when the compressor 220 is turned on and the compressor 210 is turned off.

It will also be appreciated that when the capacities of the paralleled compressors 210, 220 are uneven/unbalanced/different, and the compressors 210, 220 are operating at the same time (i.e., both are turned on), the pressure at the bottom of the compressor with a larger capacity can be lower (compared with the compressor with a lower capacity), so the suction conduit(s) need to be designed such that the lubricant can enter the compressor with lower capacity much easier than the compressor with higher capacity. For example, as illustrated in FIG. 2A, because the main suction conduit is connected to the compressor 210, the compressor 210 can obtain the lubricant in the return heat transfer fluid much easier than the compressor 220. At the same time, the pressure drop in the suction conduit 240 that is connected to the compressor 220 is also larger. If the capacity of the compressor 210 is less than or equal to the capacity of the compressor 220, since the pressure at the bottom of compressor 220 (which has a larger capacity) is smaller than the pressure of compressor 210, the lubricant can flow from the compressor 210 to the compressor 220 via the lubricant transfer conduit 250. Such suction conduit design may be more desirable in maintaining and balancing the lubricant in the compressors 210, 220, compared with a configuration that compressor 210 has a larger capacity than the compressor 220 (in which configuration, the suction conduit design needs to be changed to allow lubricant to flow back into compressor 220 much easier). It will be appreciated that such suction conduit design may be preferred even when the capacities of compressors 210, 220 are the same, such that a lubricant flow can be created between the compressors 210, 220 due to the pressure difference (the pressure in the one compressor that can easily get return lubricant is higher than the pressure of the other compressor that cannot easily get return oil), and the lubricant can flow from the one compressor to the other compressor due to pressure difference to ensure that both compressors do not lack lubricant in the sump(s).

It will be appreciated that the application of controlling OCR by using different suction conduit designs can be limited. In the embodiment of FIG. 2A, the configuration when the compressor 220 is turned on and the compressor 210 is turned off might be used, and the suction conduit design as illustrated in FIG. 2A might not achieve a desired OCR in such configuration. The degree of adjustment to the OCR due to the suction conduit design is also limited because of the limited pressure drop differences caused by suction conduit design.

Gas flow (through the lubricant transfer conduit 250) between the compressors (210, 220) under the condition of different compressors (210, 220) having different/uneven capacities (or on/off status) can disturb the lubricant circulation paths inside the compressors (210, 220) and cause a high OCR. A flow restrictor 260 can be disposed in the lubricant transfer conduit 250. The flow restrictor 260 is configured to reduce the gas flow passing through the lubricant transfer conduit 250 and thus reduce the OCR, while maintaining the lubricant equalizing capacity of the lubricant transfer conduit 250. The flow restrictor 260 can be configured to maintain the OCR of the paralleled compressors (e.g., at a stand-alone level when one compressor is on and the other compressor is off, or when one compressor has a larger capacity than the other compressor, etc.), and keep most of the lubricant inside the paralleled compressors to ensure the reliability of the compressors.

The flow restrictor 260 can be configured to increase the gas flow resistance in the lubricant transfer conduit 250 to reduce the amount and/or rate of the gas flow while ensuring that the lubricant transfer conduit 250 can still equalize lubricant, so that the amount and/or rate of the upward gas flow (through the gaps between the enclosure and the stator 215, and/or between the stator 215 and the rotor 216) can be reduced, more lubricant can be easily returned to the lubricant sump 217 via the gaps, the amount and/or percentage of lubricant discharged from the compressor can be reduced, more lubricant can be kept in the lubricant sump 217, the OCR of the paralleled compressors can be reduced, and reliability of the paralleled compressors can be improved.

In some embodiment, the flow restrictor 260 can be a perforated baffle, a mesh plate, or the like. In some embodiment, the flow restrictor 260 is disposed in or around the middle of the length of the lubricant transfer conduit 250. It will be appreciated that in or around the middle of the lubricant transfer conduit 250, the gas flow status can be stable, and the effect of reducing the gas flow (amount, rate, etc.) can be directly determined by the characteristics of the flow restrictor 260 (e.g., porosity, resistance, blocking area, etc.).

In some embodiment, the flow restrictor 260 can have different porosity. A porosity of the flow restrictor can be defined as a fraction of the area of airflow (the area of opening(s) that allows air to pass through) over the overall area (including the area of opening(s) and blocked areas) of the flow restrictor (in e.g., a cross sectional view), between 0 and 1, or as a percentage between 0% and 100%. It will be appreciated that the lubricant transfer conduit 250 (lubricant equalizer) can also be configured to balance the gas flow through the lubricant transfer conduit 250 (to reduce the pressure differences between the compressors 210, 220). When the porosity of the flow restrictor 260 is reduced, the gas flow through the lubricant transfer conduit 250 can be reduced, but the pressure difference between the compressors 210, 220 can be increased. Smaller porosity of the flow restrictor 260 may have undesirable effect on the lubricant balance between the compressors 210, 220. As such, the porosity of the flow restrictor 260 is selected at a predetermined range so that when the paralleled compressors reach a predetermined OCR range, the porosity of the flow restrictor 260 is no longer reduced.

It will be appreciated that assuming the gas flow across (the cross section of) the flow restrictor 260 is even, the capacity of the flow restrictor 260 to prevent the gas flow can be directly determined by the porosity of the flow restrictor 260. The porosity of the flow restrictor 260 is configured to reduce the gas flow (that passes through the flow restrictor 260) to a predetermined level/amount. The porosity of the flow restrictor 260 is configured so that in a full range of capacity/operation (e.g., air conditioner cooling set-point is at or about 65° F.) of the paralleled compressors, the OCR is less than 2.5% or at or about 2.5%. The porosity of the flow restrictor 260 is also configured so that in a rated capacity/operation of the paralleled compressors, the OCR is less than 1% or at or about 1%. It will be appreciated that OCR typically refers to the mass lubricant rate (the percentage of the lubricant in the refrigerant by mass/weight) in the refrigerant circuit in an HVACR system, which typically is equal/close to the mass lubricant rate in the discharge gas of the compressor(s). The OCR is typically measured by obtaining an amount of liquid refrigerant at the liquid line and measuring the weight of the lubricant and the weight of the liquid refrigerant to calculate the lubricant rate/percentage by weight in the refrigerant. In an embodiment, OCR of a compressor or manifold can be referred to as the mass lubricant rate in the discharge gas.

It will also be appreciated that a reduced OCR can result in a higher performance of the system, due to more lubricant in the system that can impact/increase the heat exchanging capability of the heat exchanger. In an embodiment, a flow restrictor may be helpful in cases where there is high OCR (e.g., over 2.5%). OCR can be directly determined by a capacity difference of the compressors and also be impacted by a compressor's internal structure (e.g., gaps), flow path, or lubricant charge amount, etc.

It will be appreciated that flow restrictor 260 can also be used in paralleled compressor system with three or more compressors. In such embodiments, a flow restrictor is disposed in each of the lubricant transfer conduit that connects a pair of compressors.

FIG. 2B illustrates the flow restrictor 260 of FIG. 2A. The flow restrictor 260 includes a top portion having at least one opening 261, a middle portion 262, and a bottom portion having at least one opening 263. The flow restrictor 260 includes opening(s) 261 at/near the top and/or opening(s) 263 at/near the bottom of the flow restrictor 260 to allow unobstructed gas flow through the flow restrictor 260 in the lubricant transfer conduit 250. The opening(s) 263 at/near the bottom is configured to ensure that the lubricant can flow from one compressor to another in time when the lubricant reaches a predetermined height in the lubricant sump (217, 218). The opening(s) 261 at/near the top is configured to keep gas flow in the lubricant transfer conduit 250 unblocked when the lubricant in the lubricant sump (217, 218) is at a level higher than a desirable level. It will be appreciated that the flow restrictor 260 can include opening (s) (e.g., 264) with various size/shape in other portion(s) (e.g., 262) of the flow restrictor 260. It will also be appreciated that the flow restrictor 260 and/or its openings can have various size/shape.

FIGS. 3A-1, 3A-2, and 3A-3 illustrate various embodiments 300, 310, 320 of a flow restrictor, according to some embodiments. The flow restrictor 300 includes a top portion having at least one opening 301, a middle portion 302, and a bottom portion having at least one opening 303. The flow restrictor 310 includes a top portion having at least one opening 311, a middle portion 312, and a bottom portion having at least one opening 313. The flow restrictor 320 includes a top portion having at least one opening 321, a middle portion 322, and a bottom portion having at least one opening 323. The flow restrictor (300, 310, 320) includes opening(s) (301, 311, 321) at/near the top and/or opening(s) (303, 313, 323) at/near the bottom of the flow restrictor (300, 310, 320) to allow unobstructed gas flow through the flow restrictor (300, 310, 320) in the lubricant transfer conduit. The opening(s) (303, 313, 323) at/near the bottom is configured to ensure that the lubricant can flow from one compressor to another in time when the lubricant reaches a predetermined height in the lubricant sump. The opening(s) (301, 311, 321) at/near the top is configured to keep gas flow in the lubricant transfer conduit unblocked when the lubricant in the lubricant sump is at a level higher than a desirable level. It will be appreciated that the flow restrictor (300, 310, 320) can include opening(s) (e.g., 304, 314, 324) with various size/shape in other portion(s) (e.g., 302, 312, 322) of the flow restrictor (300, 310, 320). It will also be appreciated that the flow restrictor (300, 310, 320) and/or its openings can have various size/shape.

It will be appreciated that the flow restrictor is configured to generate resistance that is high enough to control/reduce the gas flow in the lubricant transfer conduit, under e.g., an extreme unbalanced state (e.g., under high suction pressure and/or high load working conditions, one compressor is turned on and one compressor is turned off), so that the resultant upward gas flow does not prevent the lubricant from flowing into the lubricant sump (from the upper portion of the motor/compressor via the gaps between the enclosure and the stator and/or between the stator and the rotor) when the upward gas flow passes the gaps of the compressor that is turned on. It will also be appreciated that such control can be determined by the porosity (the area ratio of air that can pass through openings in view of the overall area including the openings and blocked areas) of the flow restrictor.

It will be appreciated that although the shape/size of the flow restrictor can vary, as long as the following conditions are met, the flow restrictors can achieve the same or similar effect in controlling/reducing the gas flow: the flow restrictors have the same/similar porosity/resistance, and/or the flow restrictors include opening(s) at/near the top and/or at/near the bottom of the flow restrictors. Opening(s) at/near the bottom can ensure that compressors start to share lubricant when the lubricant level in the lubricant sump is higher than a predetermined level. Opening(s) at/near the top can ensure that when there is more lubricant than desired, gas flow balance between the compressors can be kept.

Figures 1, 3A:
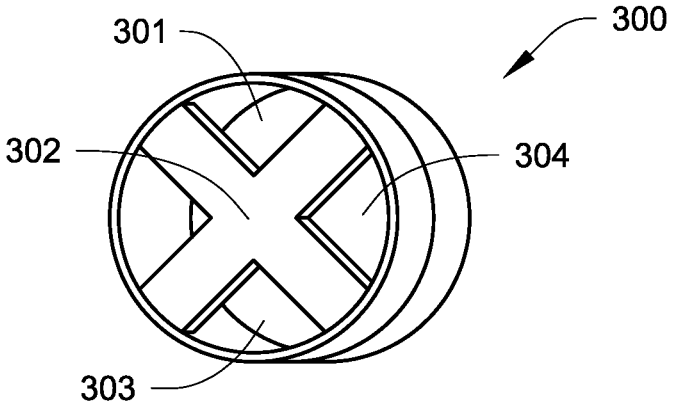
FIGS. 3A-1, 3A-2, and 3A-3 illustrate various embodiments of a flow restrictor, according to some embodiments.
Figures 2, 3A:
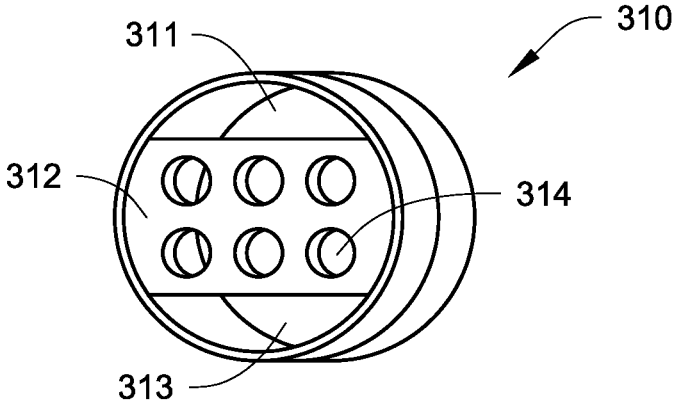
Figures 3, 3A:
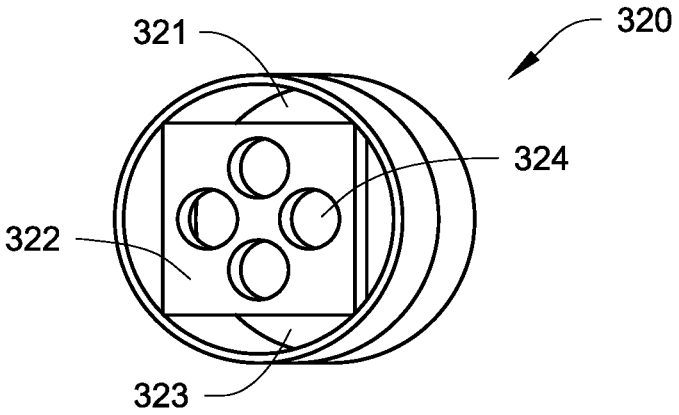
Figure 3B:
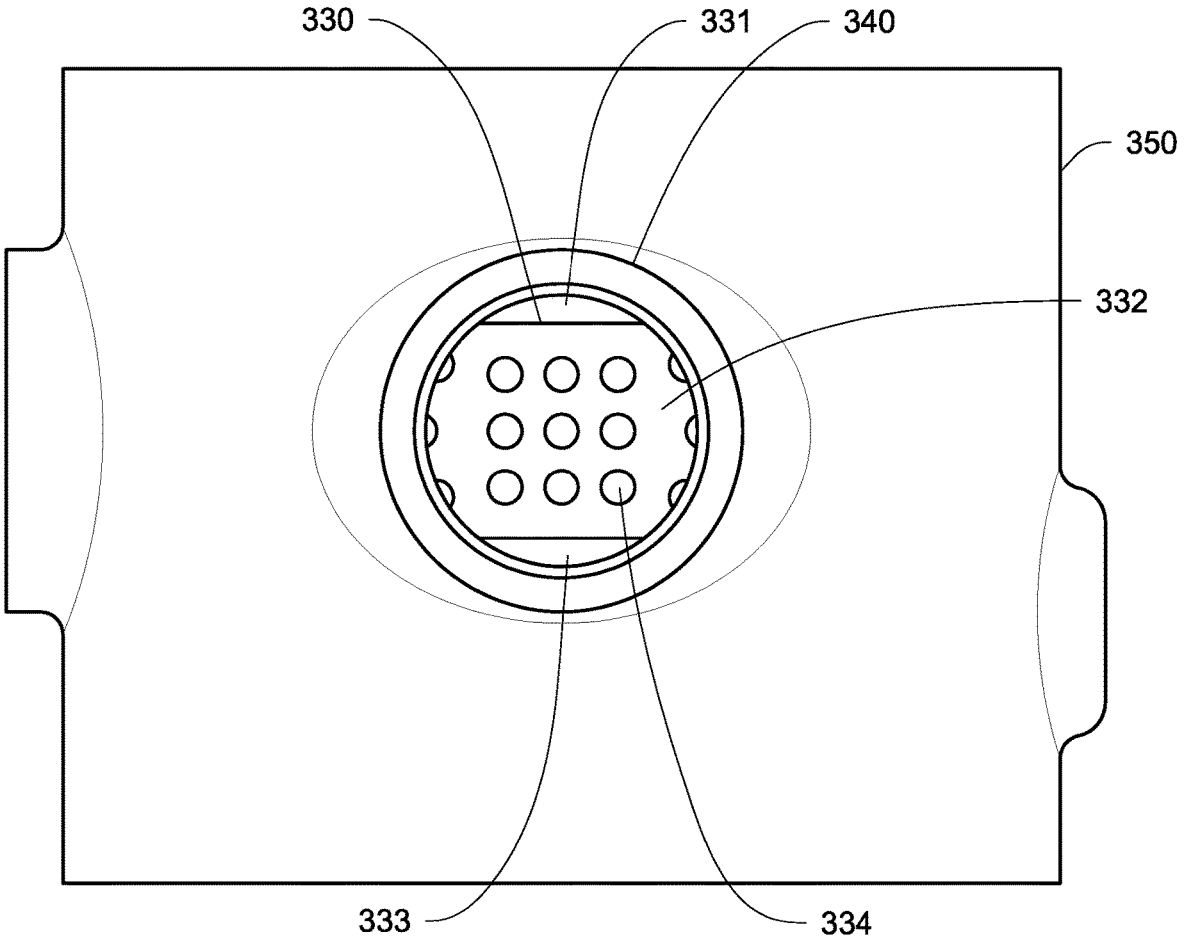
FIG. 3B is a schematic diagram of a flow restrictor disposed at the lubricant equalizer port of a compressor, according to an embodiment.

FIG. 3B is a schematic diagram of a flow restrictor 330 disposed at the lubricant equalizer port 340 of a compressor 350, according to an embodiment. The lubricant equalizer port 340 of the compressor 350 is disposed on the compressor 350 and is connected to a lubricant transfer conduit (not shown). The flow restrictor 330 includes a top portion having at least one opening 331, a middle portion 332, and a bottom portion having at least one opening 333. The flow restrictor 330 includes opening(s) 331 at/near the top and/or opening(s) 333 at/near the bottom of the flow restrictor 330 to allow unobstructed gas flow through the flow restrictor 330 in the lubricant transfer conduit. The opening(s) 333 at/near the bottom is configured to ensure that the lubricant can flow from one compressor to another in time when the lubricant reaches a predetermined height in the lubricant sump. The opening(s) 331 at/near the top is configured to keep gas flow in the lubricant transfer conduit unblocked when the lubricant in the lubricant sump is at a level higher than a desirable level. It will be appreciated that the flow restrictor 330 can include opening(s) (e.g., 334) with various size/shape in other portion(s) (e.g., 332) of the flow restrictor 330. It will also be appreciated that the flow restrictor 330 and/or its openings can have various size/shape.

Aspects:

Aspect 1. A heating, ventilation, air conditioning, and refrigeration (HVACR) system, the system comprising:

a first compressor having a first capacity, a second compressor having a second capacity, a condenser, an expansion device, and an evaporator fluidly connected;

wherein the first compressor and the second compressor are arranged in parallel, the first compressor includes a first lubricant sump, the second compressor includes a second lubricant sump, the first lubricant sump is fluidly connected to the second lubricant sump via a lubricant transfer conduit, a flow restrictor is disposed in the lubricant transfer conduit, the flow restrictor is configured to reduce a refrigerant flow between the first compressor and the second compressor.

Aspect 2. The system according to aspect 1, wherein the flow restrictor includes a top portion having a first opening, a middle portion, and a bottom portion having a second opening.

Aspect 3. The system according to aspect 1 or aspect 2, wherein the flow restrictor is configured to have a predetermined porosity to reduce the refrigerant flow between the first compressor and the second compressor to a predetermined level.

Aspect 4. The system according to any one of aspects 1-3, wherein the flow restrictor is a mesh plate.

Aspect 5. The system according to any one of aspects 1-4, wherein the flow restrictor is disposed in a middle of the lubricant transfer conduit.

Aspect 6. The system according to any one of aspects 1-5, wherein the flow restrictor is configured to maintain a lubricant circulation rate of the system at a level of at or below 2.5%.

Aspect 7. The system according to any one of aspects 1-5, wherein the flow restrictor is configured to maintain a lubricant circulation rate of the system at a level of at or below 1%.

Aspect 8. The system according to any one of aspects 1-7, wherein the first compressor includes a first suction inlet, the second compressor includes a second suction inlet, the first suction inlet is fluidly connected to a first suction conduit, the second suction inlet is fluidly connected to a second suction conduit, when the first capacity is less than the second capacity, the first suction conduit is configured to be a main conduit connected to the evaporator, the second suction conduit is configured to be branched from the main conduit.

Aspect 9. The system according to any one of aspects 1-8, further comprising a third compressor having a third lubricant sump, wherein the first compressor, the second compressor, and the third compressor are arranged in parallel.

the second lubricant sump is fluidly connected to the third lubricant sump via a second lubricant transfer conduit, and a second flow restrictor is disposed in the second lubricant transfer conduit.

Aspect 10. The system according to any one of aspects 1-9, wherein the first compressor is a variable speed compressor and the second compressor is a fixed speed compressor.

Aspect 11. The system according to any one of aspects 1-9, wherein both the first compressor and the second compressor are fixed speed compressors.

Aspect 12. The system according to any one of aspects 1-9, wherein the first and second compressors are scroll compressors.

Aspect 13. The system according to any one of aspects 1-12, wherein the first compressor includes a first motor and a first enclosure, the first motor includes a first rotor and a first stator, a first gap is located between the first enclosure and the first stator, a second gap is located between the first stator and the first rotor.

Aspect 14. The system according to aspect 13, wherein the second compressor includes a second motor and a second enclosure, the second motor includes a second rotor and a second stator, a third gap is located between the second enclosure and the second stator, a fourth gap is located between the second stator and the second rotor.

Aspect 15. The system according to any one of aspects 1-14, wherein the first capacity and the second capacity are within the range from at or about 10 tons to at or about 25 tons.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A flow restrictor used in a heating, ventilation, air conditioning, and refrigeration (HVACR) system that has a first compressor having a first capacity, a second compressor having a second capacity, a condenser, an expander, and an evaporator fluidly connected; the first compressor and the second compressor being arranged in parallel; the first compressor including a first lubricant sump, and the second compressor including a second lubricant sump; the first lubricant sump being fluidly connected to the second lubricant sump via a lubricant transfer conduit; the flow restrictor being disposed in the lubricant transfer conduit and around a middle of the lubricant transfer conduit; the flow restrictor being configured to reduce a refrigerant flow between the first compressor and the second compressor; the flow restrictor comprising:

openings including a first opening and a second opening; and blocking areas;

wherein the flow restrictor includes a top portion having the first opening, a middle portion, and a bottom portion having the second opening; and wherein an area ratio of the openings to areas including the blocking areas and the openings is configured to generate resistance to control the refrigerant flow, so that an upward refrigerant flow does not prevent lubricant from flowing down.

2. The flow restrictor according to claim 1, wherein the flow restrictor is configured to have a predetermined porosity to reduce the refrigerant flow between the first compressor and the second compressor to a predetermined level.

3. The flow restrictor according to claim 1, wherein the flow restrictor is a mesh plate.

4. The flow restrictor according to claim 1, wherein a porosity of the flow restrictor is configured to maintain a lubricant circulation rate of the system at a level of at or below 2.5%.

5. The flow restrictor according to claim 1, wherein a porosity of the flow restrictor is configured to maintain a lubricant circulation rate of the system at a level of at or below 1%.

6. The flow restrictor according to claim 1, wherein a porosity of the flow restrictor is configured to maintain a lubricant circulation rate of the system at or below a predetermined level.

7. The flow restrictor according to claim 1, wherein the first compressor includes a first suction inlet, the second compressor includes a second suction inlet, the first suction inlet is fluidly connected to a first suction conduit, the second suction inlet is fluidly connected to a second suction conduit, when the first capacity is less than the second capacity, the first suction conduit is configured to be a main conduit connected to the evaporator, the second suction conduit is configured to be branched from the main conduit.

8. The flow restrictor according to claim 1, wherein the system further includes a third compressor having a third lubricant sump, the first compressor, the second compressor, and the third compressor are arranged in parallel, the second lubricant sump is fluidly connected to the third lubricant sump via a second lubricant transfer conduit, and the system further includes a second flow restrictor disposed in the second lubricant transfer conduit.

9. The flow restrictor according to claim 1, wherein the first compressor is a variable speed compressor and the second compressor is a fixed speed compressor.

10. The flow restrictor according to claim 1, wherein both the first compressor and the second compressor are fixed speed compressors.

11. The flow restrictor according to claim 1, wherein the first and second compressors are scroll compressors.

12. The flow restrictor according to claim 1, wherein the first compressor includes a first motor and a first enclosure, the first motor includes a first rotor and a first stator, a first gap is located between the first enclosure and the first stator, a second gap is located between the first stator and the first rotor.

13. The flow restrictor according to claim 1, wherein the second compressor includes a second motor and a second enclosure, the second motor includes a second rotor and a second stator, a third gap is located between the second enclosure and the second stator, a fourth gap is located between the second stator and the second rotor.

14. The flow restrictor according to claim 1, wherein the first capacity and the second capacity are within the range from at or about 10 tons to at or about 25 tons.

15. The flow restrictor according to claim 1, wherein the system further includes suction conduits connected to the first compressor and the second compressor, wherein the first capacity is greater than the second capacity, the suction conduits are configured to allow the lubricant to return to the second compressor more easily than to the first compressor.

* * * * *